US009341991B1

(12) United States Patent
Horrall et al.

(10) Patent No.: US 9,341,991 B1
(45) Date of Patent: May 17, 2016

(54) DESKEWING MECHANISM FOR AN INTERMEDIATE TRANSFER BELT MODULE AND IMAGING DRUMS IN AN ELECTROPHOTOGRAPHIC PRINTER

(71) Applicant: Lexmark International, Inc., Lexington, KY (US)

(72) Inventors: Paul Horrall, Lexington, KY (US); Donn Duane Bryant, Lexington, KY (US); Geoffrey Kirk Carlson, Lexington, KY (US); Billy Joe Jones, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 14/717,024

(22) Filed: May 20, 2015

(51) Int. Cl.
*G03G 21/16* (2006.01)
*G03G 15/16* (2006.01)
*G03G 15/01* (2006.01)

(52) U.S. Cl.
CPC ..... *G03G 15/162* (2013.01); *G03G 15/0189* (2013.01); *G03G 21/168* (2013.01); *G03G 21/1633* (2013.01); *G03G 2215/00143* (2013.01); *G03G 2215/0125* (2013.01); *G03G 2221/1642* (2013.01); *G03G 2221/1687* (2013.01)

(58) Field of Classification Search
CPC ..... G03G 15/755; G03G 15/162; G03G 15/0189; G03G 21/1633; G03G 21/1671; G03G 21/168; G03G 2215/00143; G03G 2215/1623; G03G 2215/0122; G03G 2215/0125; G03G 2221/1615; G03G 2221/1642; G03G 2221/1678; G03G 2221/1687
USPC ..... 399/107, 121, 126, 165
See application file for complete search history.

(56) References Cited

U.S. PATENT DOCUMENTS

| | | | | |
|---|---|---|---|---|
| 5,915,153 | A * | 6/1999 | Kim | G03G 15/11 399/226 |
| 2005/0008393 | A1* | 1/2005 | Kuma | G03G 21/1633 399/110 |
| 2005/0281594 | A1* | 12/2005 | Kuma | G03G 15/0194 399/299 |
| 2007/0160383 | A1* | 7/2007 | Matsumoto | G03G 15/751 399/110 |
| 2010/0239306 | A1* | 9/2010 | Souda | G03G 21/1867 399/107 |
| 2011/0123217 | A1* | 5/2011 | Matsui | G03G 21/1633 399/107 |
| 2011/0123246 | A1* | 5/2011 | Ando | G03G 21/1619 400/622 |

* cited by examiner

*Primary Examiner* — Robert Beatty
(74) *Attorney, Agent, or Firm* — John Victor Pezdek

(57) ABSTRACT

An electrophotographic printer having an intermediate transfer belt (ITB) module having an endless belt wrapped around a first and second roll and a plurality of imaging drums, all mounted in a frame between a rear panel and an access panel pivotally mounted to the front panel. The first and second rolls lie in an ITB reference plane and the imaging drums lie in an imaging drum reference plane that is mutually planar to the ITB reference plane. A camming device, mounted to one of the front panel and the access panel, rotates the access panel to provide a skewing adjustment to ITB module and plurality of imaging drums to substantially correct a skew error caused by the racking of the front panel with respect to the rear panel with the access panel maintaining mutual planarity between the ITB reference plane and the imaging drum reference plane.

15 Claims, 10 Drawing Sheets

DESKEWING MECHANISM FOR AN INTERMEDIATE TRANSFER BELT MODULE AND IMAGING DRUMS IN AN ELECTROPHOTOGRAPHIC PRINTER

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Disclosure

The present disclosure relates generally to electrophotographic printers and, in particular, to a mechanism used to deskew imaging drums and an intermediate transfer belt module while maintaining mutual planarity between them.

2. Description of the Related Art

In electrophotographic (EP) printers, maintaining the plane of major EP systems, such as an intermediate transfer belt (ITB) module is essential to creating quality printed images. The plane of an ITB module is established by the mounting of the two rolls around which the ITB travels. The shafts of two rolls are mounted to opposed panels of a frame of the printer. In its simplest form the frame is comprised of a front and rear panel interconnected by two side panels, all of which are mounted to a bottom panel. When all of the panels are assembled together a small amount of twist or racking may occur due to manufacturing tolerances. For example one end of the front panel may be racked or twisted with respect to the rear panel by about 1.0 to 1.5 mm either in an upward or positive direction or in a downward or negative direction with respect to horizontal.

Using the rear panel as a reference plane, the mounting of the shafts of the two rolls therein establish two of the datum points needed to establish the plane of the ITB module. The third datum point is one of the two mounting locations in the front panel for the two shafts of the two rolls. However, due to the racking of the front panel, the remaining shaft end when mounted to the front panel will be either slightly above or below the plane established by the other three shaft ends resulting in a skewing of the ITB module. Situated either above or below the ITB module are four imaging drums that are designed to be in contact with the surface of the ITB and designed to lie in a common plane. The four imaging drums have their shafts mounted to the front and rear panels. Due to the racking of the front panel, the amount that each imaging drum is moved out of its common plane increases as the mounting location of the imaging drum nears the racked end of the front panel.

To correct the nonplanar position of the fourth shaft end of the roll in the ITB module so that it lies in the plane established by the first three shaft ends, an upward or downward biasing force is applied to the fourth shaft end, depending the direction in which the racking occurs, to move and hold the fourth shaft end in the plane of the ITB module. This adjustment ensures that the ITB module is essentially flat or planar. As the flatness of ITB varies from zero, the walk rate of the ITB increases the stress on the edges thereof. This increased stress induces cracks and ultimately results in failure of the ITB.

However, this solution of leveling the ITB module does not address the non-planarity of the imaging drums which may lead to print quality issues. The non-planarity introduces variations in the focal distances from the laser scan unit print head to each of the imaging drum surfaces which negatively impacts print quality. While the flatness of the plane of the ITB module may be readily adjusted by a single biasing mechanism, such a solution is not possible for the four imaging drums in that at least three shafts and possibly four shaft would need to be adjusted. With the prior art arrangement at least three adjustment mechanisms for the shaft ends of three of the imaging drums would be needed as the amount of non-planarity in the imaging drum most distant from where the highest racking occurs may be within acceptable tolerances. In a worst case, four adjustment mechanisms would be needed.

Accordingly, it would be advantageous to provide an assembly where the planarity of the ITB module may be accomplished while also being able to retain the parallel planar relationship between the ITB module and the plane of the imaging drums. It would be a further advantage to be able to accomplish the foregoing with a single adjustment.

SUMMARY

Disclosed is an electrophotographic printer having an intermediate transfer belt (ITB) module having an endless belt wrapped around a first and second roll and a plurality of imaging drums mounted between a rear panel of a frame therein and an access panel pivotally mounted to a front panel of the frame. A camming device, mounted to one of the front panel and the access panel, rotates the access panel to provide a skewing adjustment to the ITB module and the plurality of imaging drums to substantially correct a skew error caused by the racking of the front panel with respect to the rear panel with the access panel maintaining mutual planarity between the endless belt and the plurality of imaging drums.

The intermediate transfer belt (ITB) assembly has an endless belt wrapped around a first and second roll with each roll having a shaft therethrough having first and second shaft ends. The plurality of imaging drums each has a first and a second shaft end. The frame has a front panel, a rear panel, a first side panel, a second side panel and a bottom panel with the first and second side panels and bottom panel attached between the front and rear panels forming a rectangular box structure. The rear panel establishes a reference surface for the front, bottom, first side, and second side panels. The front panel has an access opening therethrough and a post mounted adjacent to one of the lower corners of the access opening. The access opening is sized to allow the ITB module and the plurality of imaging drums to be received between the front and rear panels. The rear panel has a first set of openings and second set of openings aligned parallel to one another with the first set of aligned openings receiving the second shaft ends of the first and second rolls and the second set of aligned openings receiving respective second shaft ends of the plurality of the imaging drums. The access panel is removably attached to the front panel and has a third and fourth set of openings corresponding to the first and second sets of openings in the rear panel, respectively. The third and fourth sets of openings are parallel to one another. The third set of aligned openings receives the first shaft ends of the first and second rolls and establishes an ITB reference plane while the fourth set of aligned openings receives respective first shaft ends of the plurality of the imaging drums and establishes an imaging drum reference plane parallel to the ITB reference plane. The access panel has a post opening in a lower portion thereof for rotatably receiving the post with the access panel being supported by the post and a camming device. The camming device is positioned adjacent the other one of the lower corners of the access opening. In the event that the front panel and one of the first and second side panels is in a racked position with respect to the rear panel racking the ITB reference plane and the imaging drum reference plane, rotation of the camming device provides a skewing adjustment by pivoting the access panel about the post to adjust the angle of the access panel with respect to the front panel and the one of the first and second side panels to correct the skew error due to the racked position of the front panel and the one of the first and second side panels while maintaining the mutual planarity of the ITB reference plane and imaging drum reference plane.

The first roll of the ITB module may be positioned adjacent a secondary transfer roll in the electrophotographic printer forming a nip therebetween and the post is positioned on the front panel adjacent to or on a vertical centerline of the shaft of the first roll, and, when the skewing adjustment is made, the first roll moves through a substantially horizontal path such that its elevation does not change with respect to the secondary transfer roll.

The access panel may be attached to the front panel by at least one hinge positioned along a lower edge of the access panel and a lower edge of the access opening with the at least one hinge having sufficient play to permit pivoting of the access panel by the camming device. The camming device provides a skewing adjustment having a range of about −1.5 mm to about +1.5 mm.

In one form the camming device has a body having a first portion and a second portion having a diameter that is greater than the first portion. The first portion is rotatably attached to the access panel and has a first axis of rotation. The second portion of a body is rotatably received into a corresponding hole in the front panel and has a second axis of rotation offset from the first axis of rotation wherein rotation of the camming device provides the skewing adjustment.

BRIEF DESCRIPTION OF THE DRAWINGS

The above-mentioned and other features and advantages of the disclosed embodiments, and the manner of attaining them, will become more apparent and will be better understood by reference to the following description of the disclosed embodiments in conjunction with the accompanying drawings.

DETAILED DESCRIPTION

Figure 1:
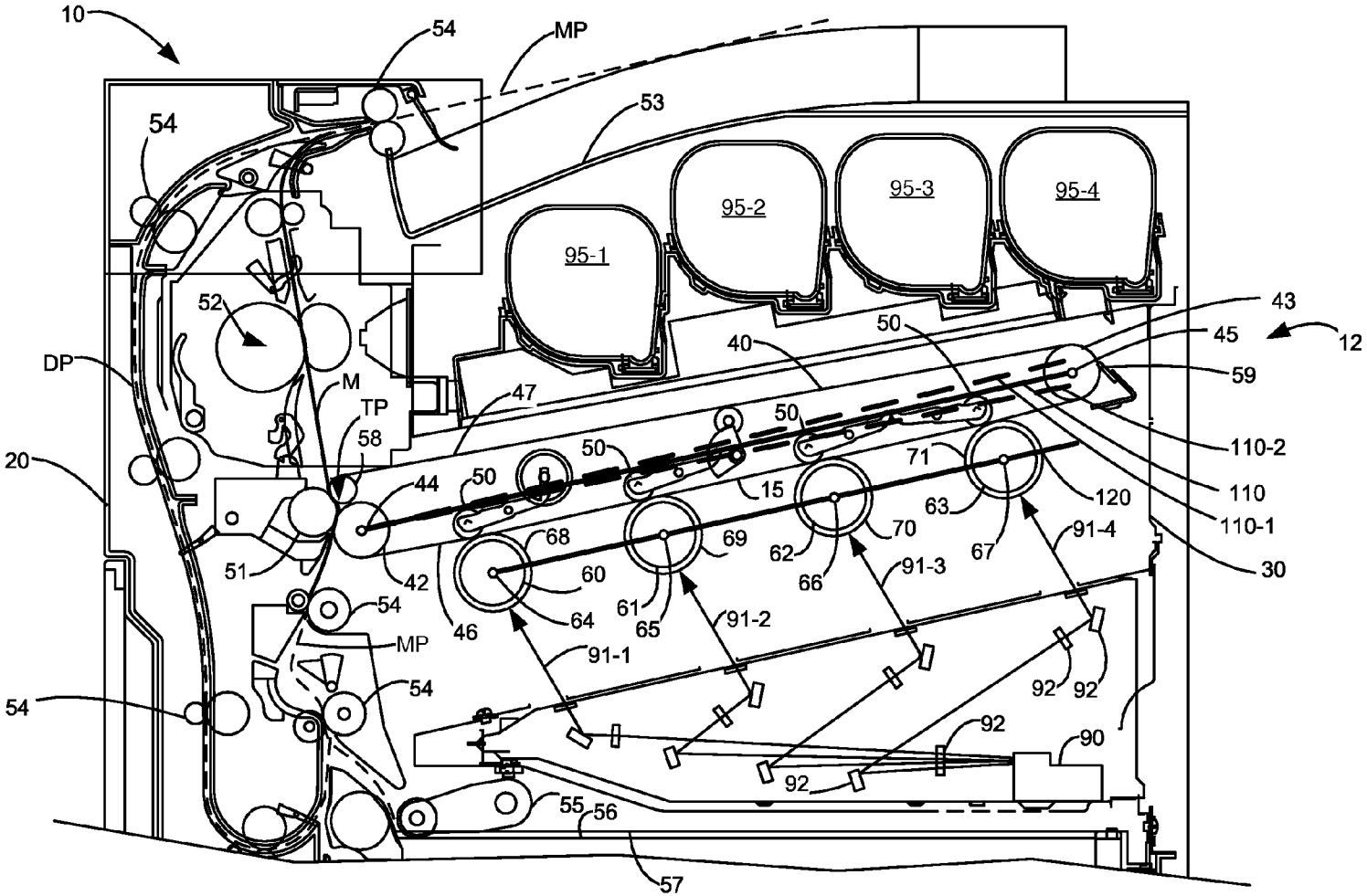
Figure 1 Prior Art
FIG. 1 is sectional front elevational view of a prior art color EP printer having an ITB module with corresponding imaging drums positioned below the ITB module.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. As used herein, the terms "having," "containing," "including," "comprising," and the like are open ended terms that indicate the presence of stated elements or features, but do not preclude additional elements or features. The articles "a," "an," and "the" are intended to include the plural as well as the singular, unless the context clearly indicates otherwise. The use herein of the terms "including," "comprising," "having" and variations thereof is meant to encompass the items listed thereafter and equivalents thereof as well as additional items.

Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings. Spatially relative terms such as "left," "right," "top," "bottom," "front," "back," "rear," "side," "under," "below," "lower," "over," "upper," and the like, are used for ease of description to explain the positioning of one element relative to a second element as viewed in the accompanying figures. These terms are intended to encompass different orientations of the device, in addition to, orientations other than those depicted in the figures. Further, terms such as "first," "second," and the like, are also used to describe various elements, regions, sections, etc. and are also not intended to be limiting. Like terms refer to like elements throughout the description.

The term "media" as used herein encompasses any material for receiving an image or containing an image. Unless otherwise stated, media is generally rectangular having a top surface or top side and a bottom surface or bottom side. The "leading edge" of the media is the first portion to enter a media feed path. The "trailing edge" of the media is the last portion of a media to enter a media feed path. The "side edges" of the media or the "left edge" and "right edge" of the media refer to the edges of the media that are parallel to the media feed path as viewed in the media feed direction. The term "media feed path" is the route along which media travels in an image forming device and refers to the path from a media input area to a media output area of the printer or any portion thereof. The term "media feed direction" or "MFD" indicates the direction that media travels within the printer or a subassembly thereof.

Unless otherwise indicated a "feed roll pair" consists of a driven roll and an idler roll that are axially aligned and which form a nip or feed nip therebetween through which media is moved along the media feed path. The driven roll is operably coupled to a drive source in the printer, and, when rotated in one direction, will feed a media in the media feed direction, and, when rotated in an opposite direction, may act to block the feeding of media in the media feed direction or feed the media in a direction opposite to the media feed direction.

Figure 3:
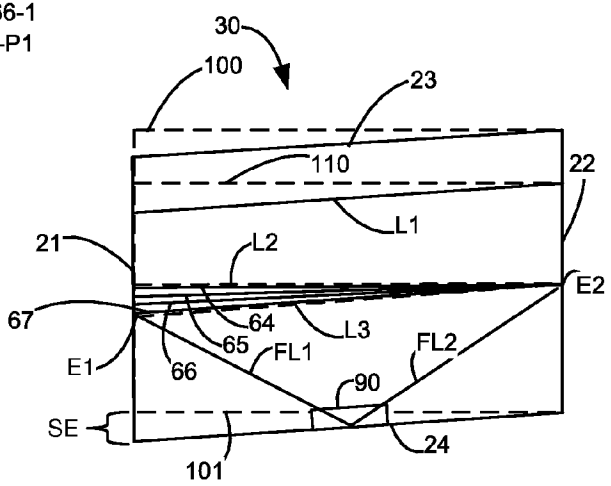
Figure 3 Prior Art
FIG. 3 is a schematic depiction of a right side view of the prior art frame of FIG. 2 and the planar relationship between the ITB module and the imaging drums.
Figure 2:
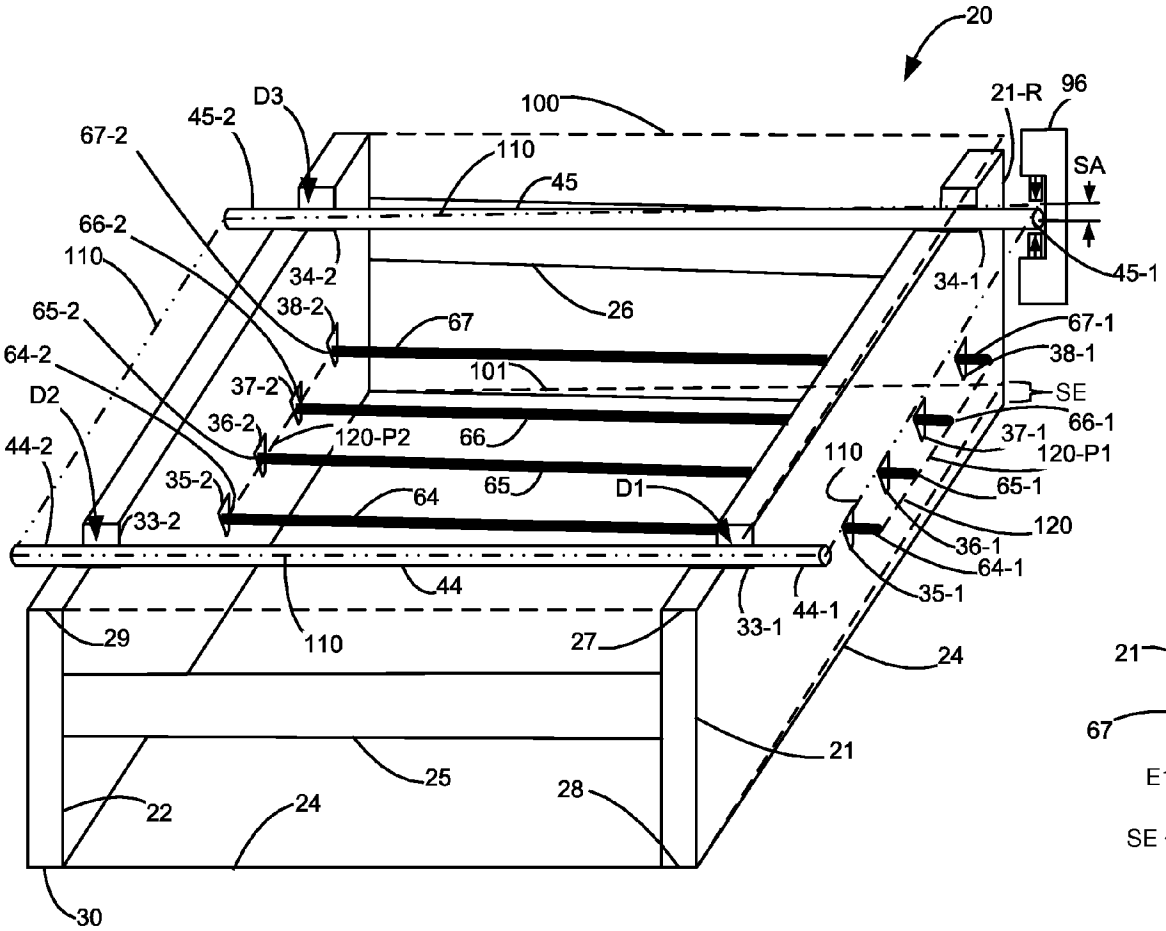
Figure 2 Prior Art
FIG. 2 is a schematic illustration of the prior art frame having negative racking showing the mounting of the ITB module and imaging drums thereto.

Referring to FIGS. 1-3, a prior art EP printer 10 is shown having a frame 20 in which an intermediate transfer belt (ITB) module 40, imaging drums 60-63, a laser scan unit 90, and toner cartridges 95-1-95-4 are mounted.

ITB module 40 includes an endless ITB 41 that is supported and stretched between two rolls 42, 43 having respective shafts 44, 45. Rolls 42, 43 are mounted on a support (not shown) positioned inside of ITB 41. Roll 42, adjacent an image transfer point TP, may be the drive roll 42 that is coupled to a drive system while roll 43 may be a spring-biased tensioning roll 43. A secondary belt roll 58 may be provided in ITB module 40 positioned adjacent to drive roll 42 and be driven at a faster rate than roll 42 to eliminate slack in ITB 41 at the transfer point TP. When installed in frame 20, shafts 44, 45 are rotatably supported at their ends in front and rear panels 21, 22 of frame 20. The shafts 44, 45 form a plane, a ITB reference plane 110, that is perpendicular to the plane of the page in FIG. 1. Tensioning roll 43 or other similar device is used to ensure that ITB 41 is stretched around rolls 42, 43 so that the bottom outer surface 46 of ITB 41 is parallel to ITB reference plane 110. A drive force is applied to drive roll 42 which in turn causes ITB 41 to rotate around rolls 42, 43. For illustrated EP printer 10, ITB 41 would be rotated clockwise.

Positioned beneath ITB module 40 are imaging drums 60-63 which are mounted in frame 20 parallel to one another and transverse to ITB 41. The shafts 64-67 of imaging drums 60-63 are positioned in a common plane 120, also referred to as the imaging drum reference plane 120, that is also perpendicular to the plane of the page in FIG. 1. Opposed mounting holes are provided in frame 20 for each imaging drum 60-63. A line drawn tangent to the outer surfaces 68-71 of imaging drums 60-63 would be parallel to imaging drum reference plane 120. ITB 41 is positioned so that its bottom outer surface 46 crosses the outer surfaces 68-71 and is parallel thereto. With the ITB reference plane 110 and imaging drum reference plane 120 being parallel, the bottom outer surface 46 of ITB 41 will be parallel to imaging drums 60-63.

Positioned below imaging drums 60-63, is a laser scan unit 90 that provides laser beams 91-1-91-4 that are directed by optical devices 92, such as mirrors and lenses, to impinge on the outer surfaces 68-71, respectively, of imaging drums 60-63 forming latent images thereon. Care is taken so that the focal lengths or travel distances of laser beams 91-1-91-4 are substantially identical so that the beam diameters at the imaging drums outer surfaces 68-71 are substantially identical. Toner supplied from toner cartridges 95-1-95-4 is transferred to the latent images on imaging drums 60-63, respectively, to form toned images. Toner cartridges 95-1-95-4 may contain black, cyan, magenta, and yellow toners used to create color images. The toned images are transferred to the bottom outer surface 46 of ITB 41 where it passes across the outer surfaces 68-71 of imaging drums 60-63. ITB 41 is rotating in a clockwise direction as viewed in FIG. 1. After passing imaging drum 60 a toned color image is formed on the bottom outer surface 46 of ITB 41. Charged toner transfer rolls 50 may be provided within ITB module 40 to transfer the toned images onto the bottom outer surface 46 of ITB 41. The toned color image is carried by ITB 41 to a secondary transfer roll 51 forming a nip at transfer point TP with roll 42 and ITB 41. At transfer point TP, the toned color image is transferred to a media sheet M that is then fed to fuser assembly 52 where the toned color image is fused to media sheet M. Secondary belt roll 58 forms with secondary transfer roll 51 a second nip downstream of the transfer point TP through which ITB 41 passes. Media sheet M is then directed in the media feed direction along a media path MP indicated by the dashed line to a media output area 53 or to a duplex path DP to be fed again past transfer point TP for imaging on the opposite side thereof. Various feed roll pairs 54 are used to direct media sheet M along the media path MP and duplex path DP. Media sheet M may be fed by a pick mechanism 55 from a media stack 56 in media tray 57 within printer 10. A scraper 59 may be provided to remove residual toner from the outer surface of ITB 41 as it returns to imaging drum 63 to receive a new toned image.

Frame 20 has front and rear panels 21, 22 connected by side panels 25, 26. Side panels 25, 26 may also be referred to as left and right side panels 25, 26. Bottom and top panels 23, 24 are also connected to front and rear panels 21, 22. The panels form a generally rectangular box-like structure. Front and rear panels 21, 22 are each formed as a single metal sheet, while the remaining panels may be formed of one or more members. For the purposes of illustration, rear panel 22 serves as a datum plane against which the remaining panels are referenced. Ideally, the tops 27, 29 and bottoms 28, 30 of front and rear panels 21, 22 lie in respective top panel and bottom panel planes 100, 101. Aligned mounting holes 33-1, 33-2, 34-1, 34-2 are provided in front and rear panels 21, 22 and receive shaft ends 44-1, 44-2, 45-1, 45-2, respectively of ITB module 40.

With shaft ends 44-1, 44-2 and 45-2 in place in mounting holes 33-1, 33-2, 34-2 three datum points D1, D2, D3, respectively, are established and form the ITB reference plane 110 that is substantially parallel to top and bottom planes 100, 101, when there is little or no racking or skewing of the frame 20. Aligned mounting holes 35-1 and 35-2, 36-1 and 36-2, 37-1 and 37-2, 38-1 and 38-2 in front and rear panels 21, 22, respectively, receive the respective ends of shafts 64-67 imaging drums 60-63, respectively. The ends 64-1-67-1 and ends 64-2-67-2 of shafts 64-67 lie along lines 120-P1, 120-P2, respectively, at front and rear panels 21, 22, respectively, forming, along with shafts 64 and 67 an imaging drum reference plane 120. Again, the mounting holes may be V-shaped or squared-off to be self-centering. Without racking or skewing, ITB reference plane 110 and imaging drum reference plane 120 are parallel to one another and are parallel to top and bottom panel planes 100, 101.

When assembled, frame 20 may be between 0.5 mm and 1.5 mm out of flatness (skewed) as a result of assembly variations and part tolerances of the frame components. This variation is also seen by the ITB module 40 datums D1-D3 in the frame 20. In FIGS. 2-3, a downward racking, also referred to as negative skewing, of front panel 21 along the right edge 21-R thereof is shown. With shaft end 45-1 resting in mounting hole 34-1, the center of shaft 45 at shaft end 45-1 would lie below the ITB reference plane 110 by an amount equal to the indicated skew error SE and shaft 45 would lie along line L1 shown in FIG. 3. Similarly, the top 27 and bottom 28 of front panel 21 at right side 21-R lie below top and bottom panel planes 100, 101 by the same amount. The racking of front panel 21 may also occur in an upward direction, and may also be referred to as positive skew. The skew error SE may be in the range of −1.5 mm-+1.5 mm and has been exaggerated in the figures for purposes of illustration. To return ITB 41 to a planar state, a biaser or camming device 96 is provided, to move shaft end 45-1 back into the ITB reference plane 110 to reduce the skew error SE to essentially zero (−0.2 mm to +0.2 mm). Biaser 96 may provide positive and negative skew adjustment SA (indicated by the upward and downward arrows) to shaft end 45-1. For the illustrated negative skewing of roll shaft 45 and when applying a positive skew adjustment SA with biaser 96, the centerline of shaft 45 would be raised to lie in ITB reference plane 110. The skew adjustment SA is approximately equal to the skew error SE. An opposite skew adjustment would occur had front panel 21 been positively skewed. It will be recognized, the biaser 96 is only needed on the shaft end of the four shaft ends that is not used to establish datum points D1-D3 of ITB reference plane 110. The mounting locations of shaft ends 44-1, 44-2, 45-2 in front and rear panels 21, 22, were used to establish datum points D1-D3 only for purposes of illustration and not limitation. Any combination of the three mounting locations of shaft ends 44-1, 44-2, 45-1, 45-2 may be used as datum points D1-D3 with biaser 96 being used on the shaft end not used to established the three datum points D1-D3.

As previously discussed, no biasers or deskewing adjustments are provided for the shafts 64-67 of imaging drums 60-63 resulting in the imaging drum reference plane 120 being skewed with respect to ITB reference plane 110. As shown in FIG. 3, shafts 64-67 lie in the skewed imaging drum reference plane 120, indicated by lines L2 and L3 where L2 represents the imaging drum reference plane 120 at shaft 64 and L3 represents the imaging drum reference plane 120 at shaft 67 that is closest to right edge 21-R of front panel 21. Imaging drum 63 and shaft 67 have the highest skew error of the four imaging drums 60-63 as they are closest to the right side 21-R of front panel 21. The skew error for imaging drum 63 is approximately the same or just slightly less than skew error SE at the right side 21-R of front panel 21.

Indicated in FIG. 3 are points E1 and E2 at the rear and front panels 22, 21 for imaging drum 63. At points E1 and E2 a laser beam 91-4 from LSU 90 traversing imaging drum 63 from front to back would have the same focal lengths if the LSU 90 scan unit were horizontal and laying in an unskewed bottom panel plane 101. Because bottom panel 24 is skewed downward going from rear panel 22 toward front panel 21, the focal length FL2 of laser beam 91-4 from LSU 90 has the smallest of skew error at the drum end adjacent rear panel 22 (point E2). The skew error increases as the laser beam travels from the end of imaging drum 63 adjacent rear panel 22 toward the end of imaging drum 63 adjacent the front panel 21 until at point E1 the focal length FL1 has a skew error of about minus SE. At point E1 the focal length FL1 of the laser beam 91-4 is greater than intended leading to spot degradation of laser beam 91-4 on imaging drum 63. Laser beams 91-1-91-3 may also suffer from skew error but to a lesser extent in that the amount of skew error decreases as one proceeds from imaging drum 63 to imaging drum 60 which may have little or no skew.

As is shown in FIG. 1, the adjustment of the ITB reference plane 110 indicated by line 110-1 for positive skew adjustment (i.e., the shaft is raised) and line 110-2 for negative skew adjustment (i.e., the shaft is lowered) does not affect the position of the imaging drum reference plane 120 and, after a skew adjustment is made, these two planes will no longer be parallel with respect to each other. In addition to the variation in the focal lengths from the LSU 90 head to the surface of the imaging drums 60-63, the non-planarity between the ITB reference and imaging drum reference planes 110, 120 results in force variations between the toner transfer rolls 50 in the ITB module 40 and their corresponding imaging drums 60-63. This force variation results in print quality degradation. To correct planarity or flatness of the imaging drum reference plane 120 so that it would be parallel to the adjusted ITB reference plane would require that each mounting location of the four imaging drums on one side of the frame have some degree of vertical adjustment unlike with ITB module 40 where only a single adjustment be made. As illustrated in FIG. 1, imaging drum 60 would require the least amount of skew adjustment with the amount of skew adjustment increasing when going to imaging drum 61 then to imaging drum 63 and then with greatest amount of skew adjustment needed at imaging drum 64.

Figure 4:
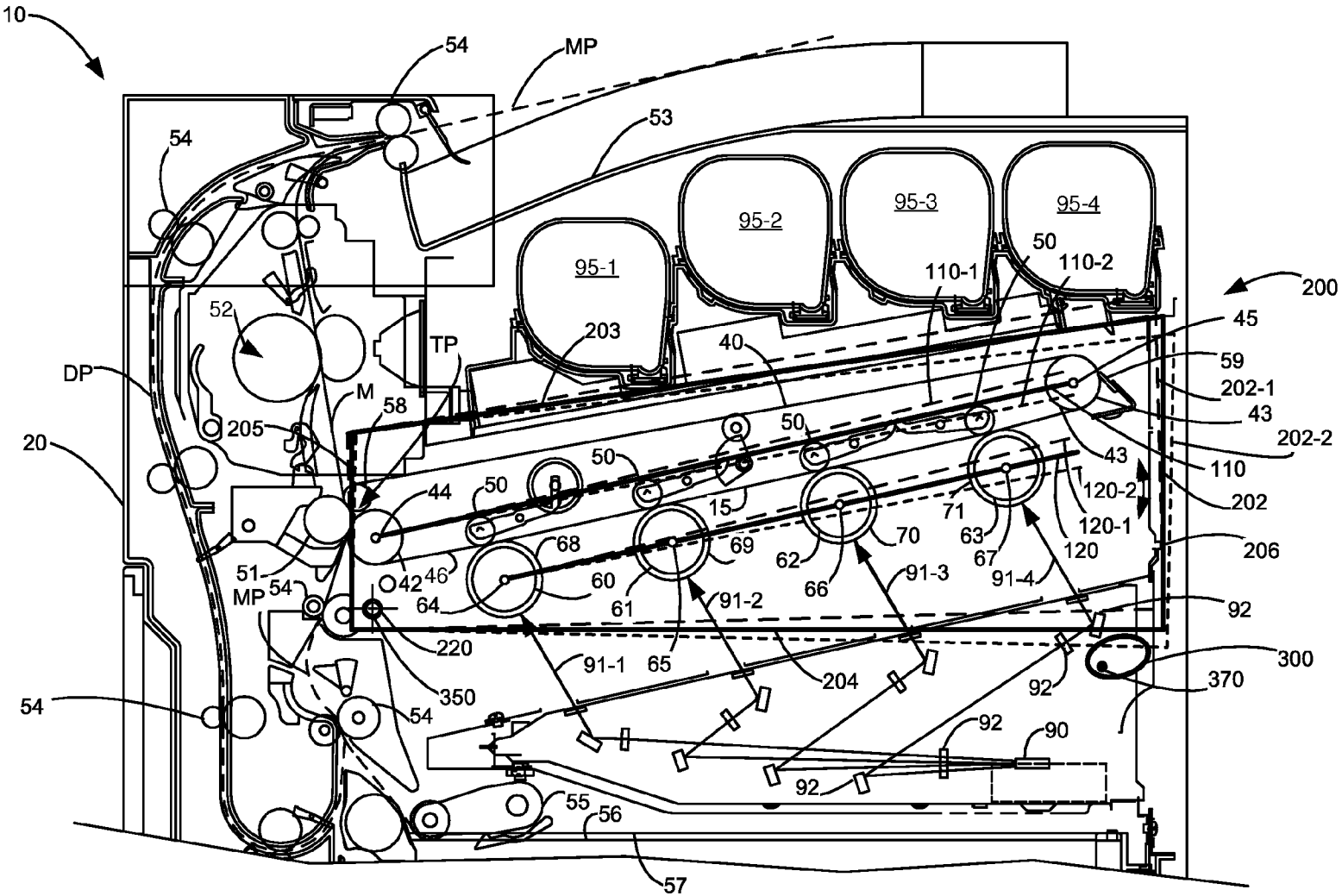
FIG. 4 is sectional front elevational view of a color EP printer utilizing an planar adjustment mechanism of the present disclosure.
Figure 5:
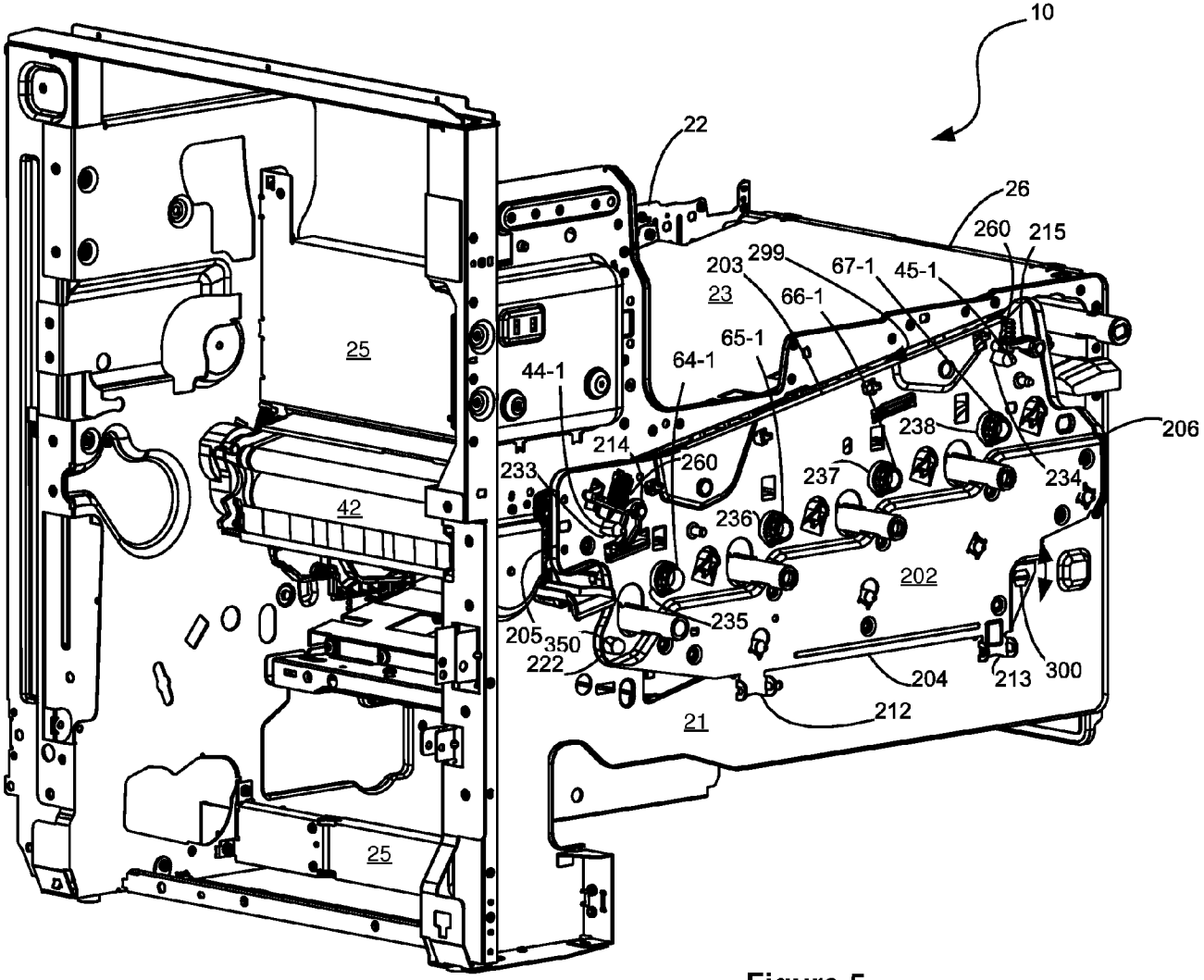
FIG. 5 is a front and left side perspective view of a color EP printer having an example embodiment of the planar adjustment mechanism of the present disclosure in a closed position.
Figure 6:
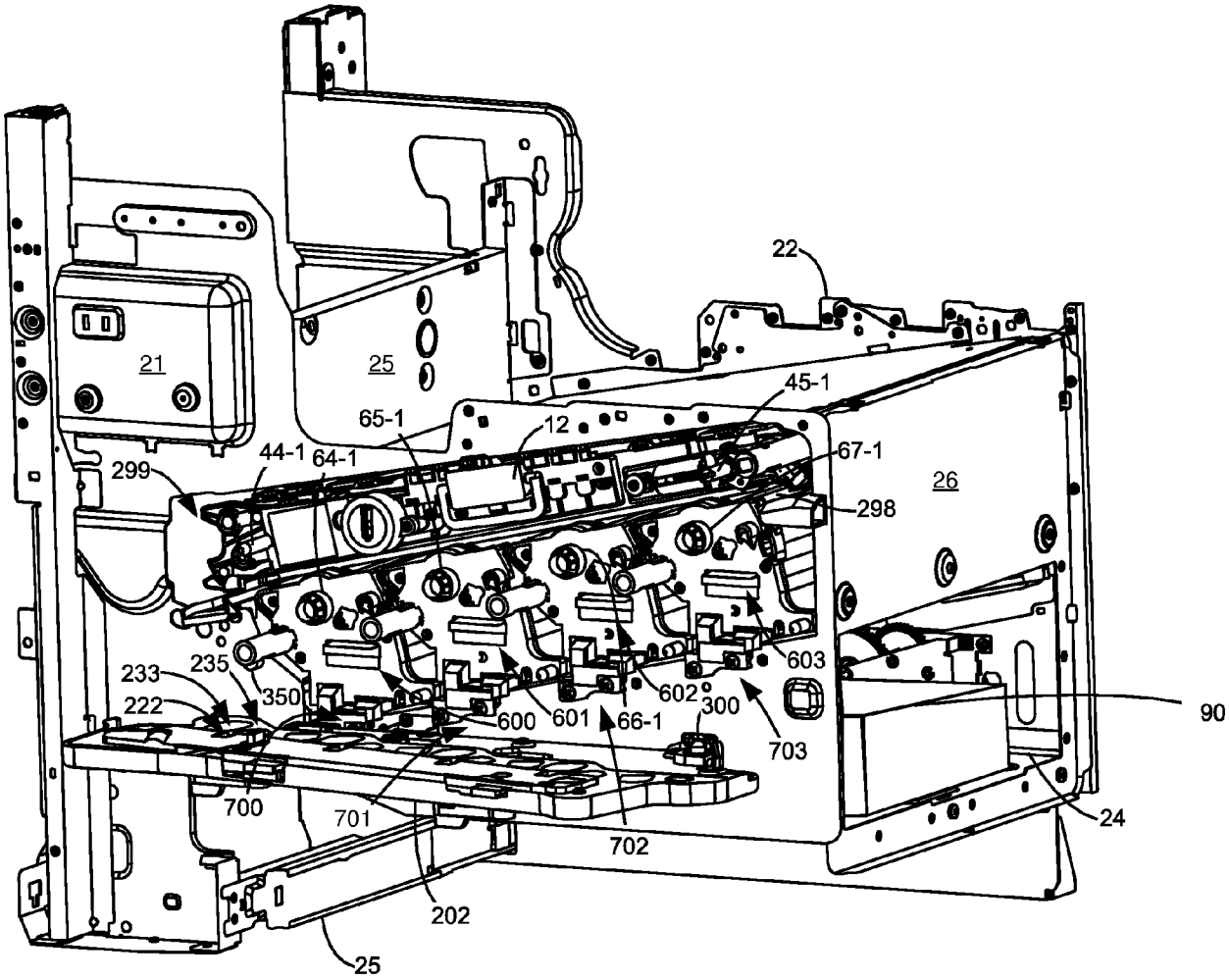
FIG. 6 is a front and right side perspective view of the color EP printer of FIG. 5 with an access panel of the planar adjustment mechanism in an open position to show the ITB module and corresponding imaging units housing the imaging drums.
Figure 7:
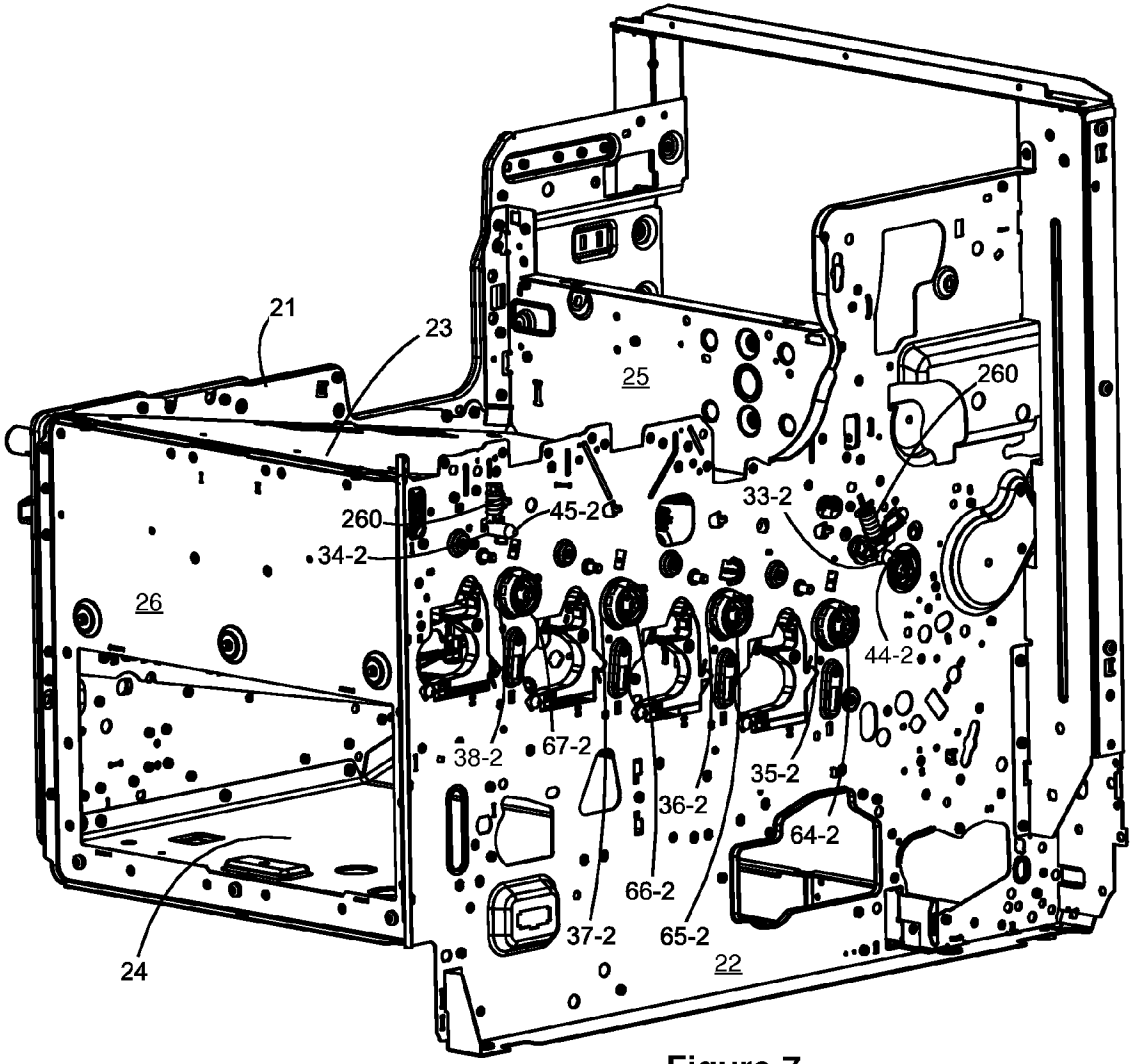
FIG. 7 is a rear and right side perspective view of the color EP printer of FIG. 5.
Figure 9:
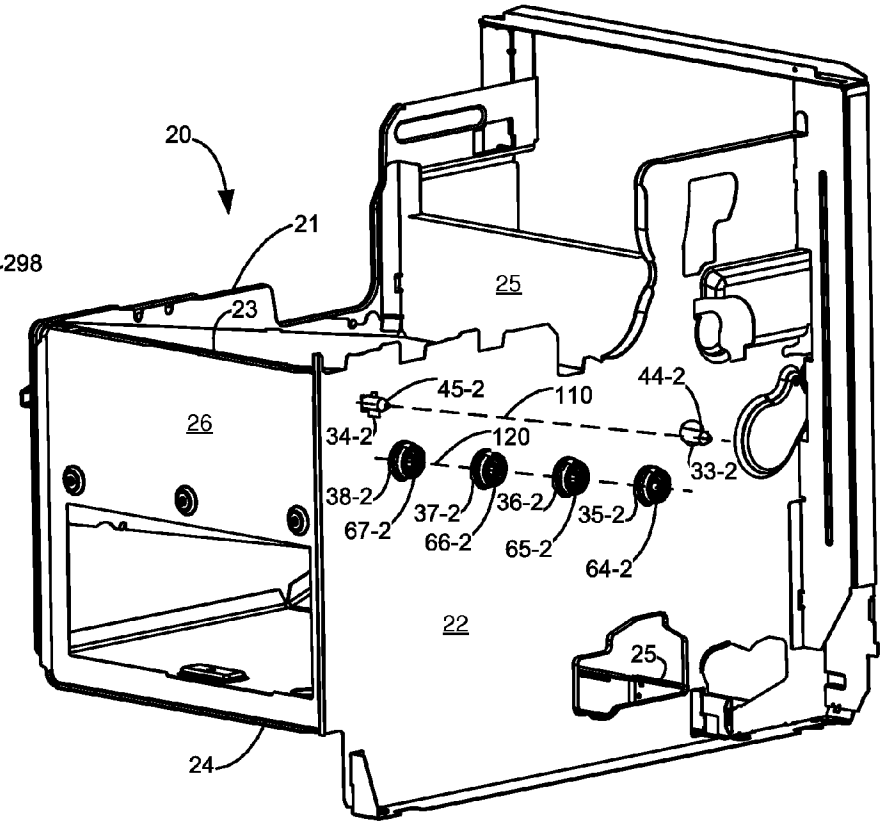
FIGS. 8-9 are simplified front and rear views of the color EP printer of FIG. 5.
Figure 8:
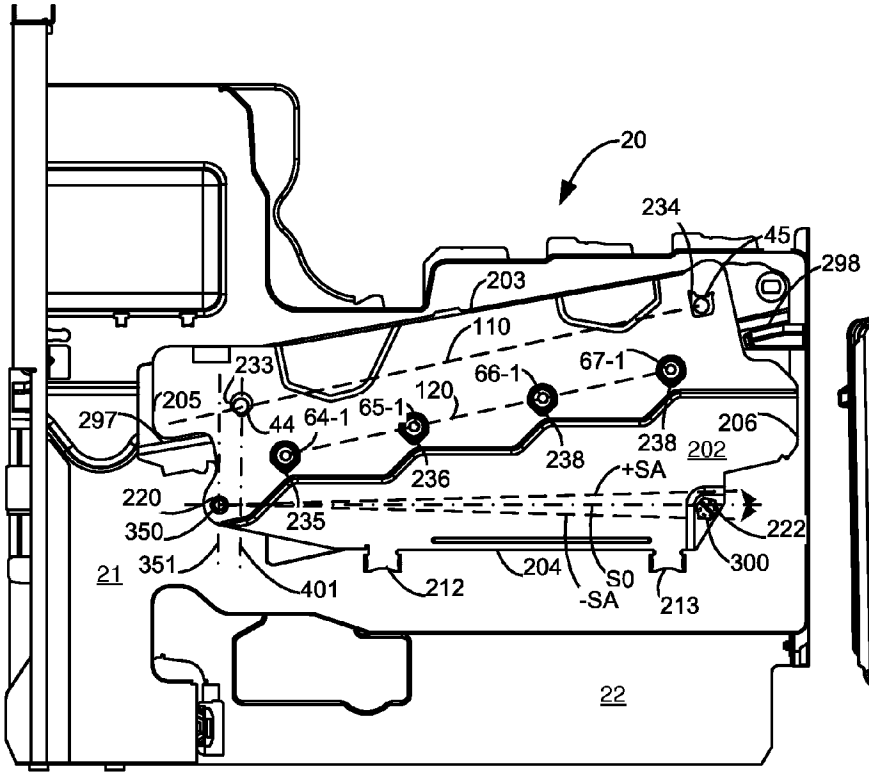

FIG. 4 illustrates a schematic embodiment of the planarity adjustment mechanism (PAM) 200 used on EP printer 10 shown in FIG. 1. FIGS. 5-7 illustrate an example embodiment of the PAM 200. FIGS. 8-9 illustrate a modified frame 20 having various openings and features removed to better see the features of PAM 200 and the mounting features provided on frame 20. PAM 200 functions in conjunction with the openings 33-2, 34-2 and openings 35-2-38-2 provided in rear panel 21 as previously described.

PAM 200 comprises an access panel 202, and a camming device 300. Access panel 202 is pivotally mounted to front panel 21 and has a top 203, bottom 204, and left and right sides 205, 206. An opening 222 is provided adjacent to the lower left corner of access panel 202 to receive a post 350 mounted on front panel 21. Camming device 300 is mounted either to front panel 21 of frame 20 adjacent to a lower right corner as shown in FIG. 4 or to access panel 202 adjacent to the lower right corner as shown in FIGS. 5 and 8. Access panel 202 is provided with two sets of openings. The first set of openings has aligned openings 233, 234 that receive shaft ends 44-1, 45-1 and which correspond to openings 33-1, 34-1. Openings 233, 234 are also aligned with openings 33-2, 34-2 in rear panel 22. The second set of openings 235-238 receive shaft ends 64-1-67-1 of shafts 64-67 and correspond to openings 35-1-38-1. Openings 235-238 align with openings 35-2-38-2 in rear panel 22.

Openings 233, 33-2 may be self-centering openings while openings 234, 34-2 may be used to establish the elevation of roll 44 within frame 20. Openings 234, 34-2 may also be self-centering openings. The term "shaft end" also includes conical end caps that may be inserted into each end of the imaging drums 64-67 such as those shown in FIGS. 5-9.

In FIG. 4, rotation of camming device 300 against the bottom 204 of access panel 202 pivots access panel 202 about post 350 either upwardly or downwardly as indicated at dashed outlines 202-1, 202-2, respectively, to provide positive and negative skew adjustment to the ITB reference plane 110 and the imaging drum reference plane 120 to correct the negative or positive skew error in front panel 21 due to the racking of front panel 21 with respect to rear panel 22. Because the shaft ends 44-1, 45-1, and shaft ends 64-1-67-1 are mounted in access plate 202, as the skew adjustment is applied to access panel 202, all of the shaft ends move in unison. Accordingly, ITB reference plane 110 and imaging drum reference plane 120 move in unison as indicated by dashed lines 110-1, 110-2 and 120-1, 110-2, respectively, and maintain mutual planarity.

In FIGS. 5-6, access panel 202 is shown in its closed and open positions with respect to opening 299 in front panel 21. Post 350 is received in opening 220 is located at the lower left corner of access panel 202. Camming device 300 is illustrated as being mounted on access panel 202 at the lower right end thereof. Hinges 212, 213 are provided along the bottom 204 of access panel 202 and latches 214, 215 are provided adjacent the top of access panel 202 and are engageable with a top edge of opening 299 in front panel 21. Hinges 212, 213 have sufficient play to allow for camming device 300 to provide the needed range of skew adjustment (−1.5 mm to +1.5 mm) In FIG. 6, with ITB module 40 inserted through opening 299, ITB module 40 can be seen resting on left and right rails 297, 298 provided on side panels 25, 26, respectively. Below ITB module 40 are imaging units 600-603 housing imaging drums 60-63. First shaft ends 64-1-67-1 (in the form of conical end caps) are seen projecting outwardly from imaging units 600-603, respectively. Imaging units 600-603 are inserted through opening 299 and travel along respective track assemblies 700-703 mounted between front and rear panels 21, 22. With ITB module 40 and imaging units 600-603 inserted, shaft ends 44-2, 45-2 seat in openings 33-2, 34-2 and shaft ends 64-2-67-2 seat in self-centering openings 35-2-38-2 in rear panel 22. When access panel 202 is returned to its closed position, ITB module 40 is lifted off of left and right rails 297, 298 by the action of shaft ends 44-1, 45-1 entering openings 233, 234, respectively. Shaft ends 64-1-67-1 similarly seat themselves in self-centering openings 235-238 respectively. FIG. 7 shows rear panel 22 having openings 33-2, 34-2 for shaft ends 44-2, 45-2, respectively and self-centering openings 35-2-38-2 for shaft ends 64-2-67-2 with ITB module 40 and imaging units 600-603 installed. Biasing members 260 may be provided on access panel 202 and rear panel 22 to apply a biasing force to shaft ends 44-1, 44-2, 45-1, 45-2 (see FIGS. 5 and 7) to ensure proper seating of shafts 44, 45 in the access panel 202 and rear panel 22. LSU 90 can be seen mounted on bottom panel 24 through the opening in side panel 26.

FIGS. 8-9 show the front and rear panels 21, 22 of frame 20 with many of the openings removed to better illustrate the features of the present disclosure. In FIG. 9 the rear edge of ITB reference plane 110 between second shaft ends 44-2, 45-2 of rolls 44, 45 and the rear edge of imaging drum reference plane 120 extending through the centers of second shaft ends 64-2-67-2 of imaging drums 60-63 are indicated on rear panel 22. In FIG. 8, the front edge of ITB reference plane 110 between first shaft ends 44-1, 45-1 of rolls 44, 45 and the front edge of imaging drum reference plane 120 extending through the centers of first shaft ends 64-1-67-1 of imaging drums 60-63 are indicated on front panel 21. Also shown on front panel 21 are post 350 extending through opening 220 and camming device 300 extending through opening 222 (see FIG. 12) at the lower left and right corners of access panel 202, respectively. Camming device 300 is received into a corresponding opening 360 in front panel 21. The range of skewing adjustment of access plate 202 is indicated by dashed lines +SA and −SA for positive and negative skew adjustment positioned about line S0 drawn through the centers of post and hole 350, 220 and camming device 300 and openings 222, 360 indicating zero skew adjustment. As shown, the mutual planar relationship between the two planes 110, 120 is maintained when access plate 202 is rotated about post 350.

Figure 10:
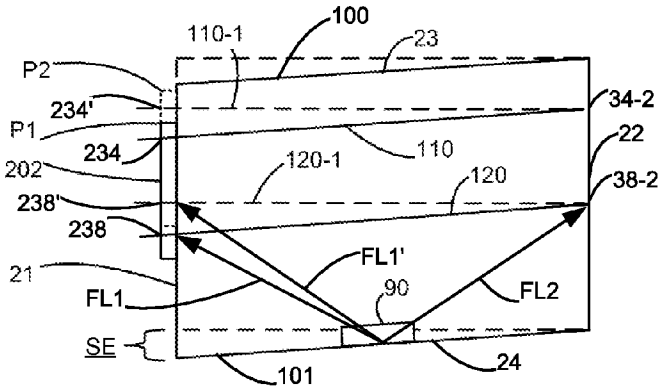
FIG. 10 is a schematic depiction of a right side view of the frame of the color EP printer of FIG. 5 and the planar relationship between the ITB module, the imaging drums, and a laser scan unit.

FIG. 10 schematically shows from right side panel 26 a positive skew adjustment being made when right edge of front panel 21 is negatively skewed with respect to rear panel 22. Top panel 23, bottom panel 24 and right side panel 26 are also negatively skewed with respect to rear panel 22. At point P1, access panel 202 is in a negatively skewed position as are ITB reference plane 110 and imaging drum reference plane 120. Openings 234 and 238 are also indicated on the access panel 202. The negative skew error is designed SE in the figure. At point P2, using camming device 300, access panel 202 has been rotated upwardly with respect to front panel 21 by a skew adjustment SA equal to the skew error SE raising both the reference planes 110, 120 to the positions indicated by lines 110-1, 120-1, respectively. Openings 234, 238 have moved to the positions indicated at 234', 238', respectively. LSU 90 is centered between the respective ends of the imaging drums 60-63 on bottom panel 24. After the skew adjustment has been made, the racking on bottom panel 24 has not been changed and LSU 90 is still in a negatively skewed positioned. However, unlike the situation shown in FIG. 3, here the focal lengths of the laser beams have been altered by the skew adjustment. As shown, focal length FL1 at the front panels has been adjusted to focal length FL1' which now more closely matches focal length FL2 which has only been minimally changed as a result of the skew adjustment. Again, for the illustrated skew error, the greatest change in focal length will occur with the imaging drum located nearest to the right edge of front panel 21, i.e., imaging drum 63 and laser beam 91-4, with lessening corrections being made as the imaging drum's position moves away for the right edge.

Figure 11:
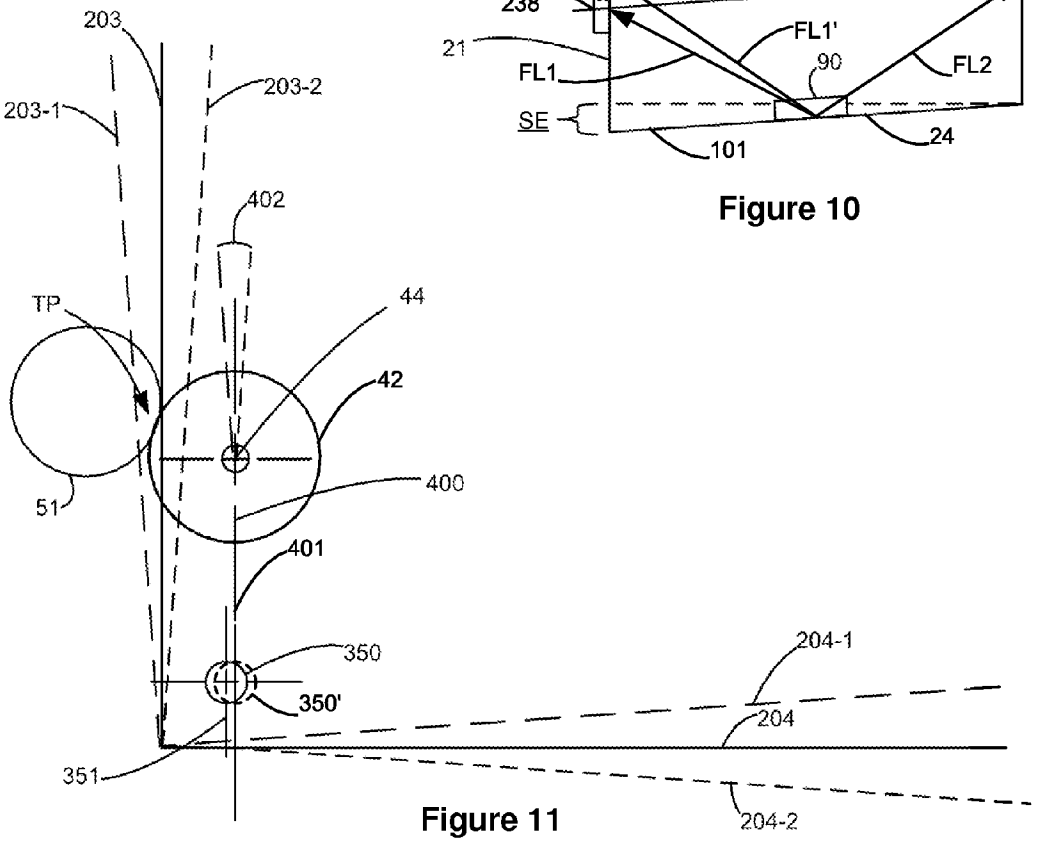
FIG. 11 is an illustration of the movement during skew adjustment of a roll in the ITB module that is adjacent to a point at which the toner image is transferred to a media sheet.

Referring to FIG. 11 shown are two vertical centerlines 351, 401 of post 350 and roll 42 and shaft 44. With the vertical centerline 351 of post 350 is shown slightly outboard of the vertical centerline 401 of roll 42 and shaft 44, when access panel 202 is rotated, roll 42 will move in a substantially horizontal path 402 as shown in FIG. 11 so that the elevation of roll 42 does not substantially change with respect to secondary transfer roll 51 during the skew adjustment. Alternatively post 350 may be positioned on vertical centerline 401 as shown at 350' or even slightly inboard of that position. Dashed lines 204-1, 204-2 represent the movement of the bottom 204 of access panel 202 and dashed lines 203-1, 203-2 represent the movement of left edge 203 of access panel 202 through the full range of skew adjustments from +SA to −SA shown in FIG. 8. To avoid issues caused by a change in the elevation or vertical position of roll 42 within frame 20 for a given range of skew adjustment, post 350 and opening 220 should be positioned within a predetermined range about either side the vertical centerline 401 of roll 42 such that at either a skew adjustment of +SA or −SA the elevational change in roll 42 is about +0.02 mm and −0.02 mm, respectively. Should post 350 and hole 220 be positioned about either side of the vertical centerline 401 of roll 42 such that the elevational change of roll 42 exceeds ±0.02 mm, roll 42 would rotate through a larger arc that would affect the nip pressure at transfer point TP between roll 42 and secondary transfer roll 51 possibly causing print quality issues.

Figure 12:
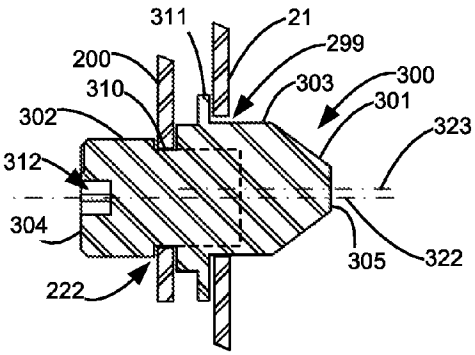
FIG. 12 is a sectional view of a camming device used in the planar adjustment mechanism.

FIG. 12 illustrates one example embodiment for camming device 300. There camming device 300 has a body 301 having a first portion 302 and second portion 303. First portion 302 includes a hexagonal head 304 and a channel or groove 310 and is sized to be received in opening 222 in access panel 202. Head 304 may also be provided with a slot 312 that may be used to rotate camming device 300. Channel 310 separates first portion 302 from second portion 303 and helps to retain camming device 300 in access panel 202. When opening 222 is sized to extend into channel 310, first portion 302 may be threaded into second portion 303 as indicated by the dashed lines to capture access panel 200 in channel 310. Second portion 303 has a diameter that is greater than the diameter of first portion 302. Second portion 303 is received into opening 360 in front panel 21. A flange 311 may be provided on second portion 303 to limit insertion depth of second portion 303 into opening 360. Body 301 has two rotational centerlines 322, 323 for first and second portions 302, 303, respectively, that are offset from one another. First portion 302 rotates about centerline 322 while second portion 303 rotates about centerline 323 allowing second portion to have an elliptical orbit providing positive and negative skew adjustment.

Figure 14:
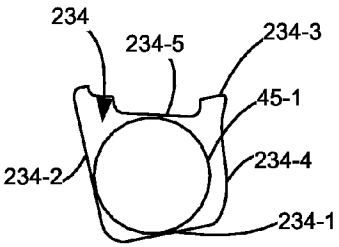
FIGS. 13-14 are two example embodiments of a self-centering opening or hole.
Figure 13:
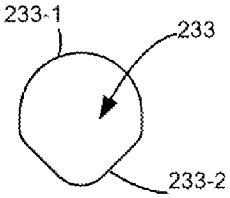

FIG. 13 illustrates an example of a self-centering opening, such as opening 233 while FIG. 14 illustrates an opening used to establish a given elevation for shaft 45 such as opening 234. Opening 233 has an upper circular portion 233-1 and a lower V-shaped portion 233-2 that provides support for shaft end 44-1. Similar openings are used for openings 33-2, 235-238 and 35-2-38-2. Opening 234 is generally rectangular where shaft end 45-1 rests on the bottom side 234-1. Bottom side 234-1 locates the elevational position of shaft end 45-1. A tab 234-4 may be provided in one of the sides of opening 234 opposite to side 234-2 or 234-2. Biasing member 260 may bias shaft end 45-1 against one of the vertical sides 234-2 or 234-4. As shown, a tab 234-5 is opposite to bottom side 234-1 and is used to limit the motion of shaft end 45-1 within opening 234 during shipping of imaging device 10. A similar opening may be used for opening 34-2 having shaft end 45-2. Alternatively, all the openings may be self-centering.

Figure 15:
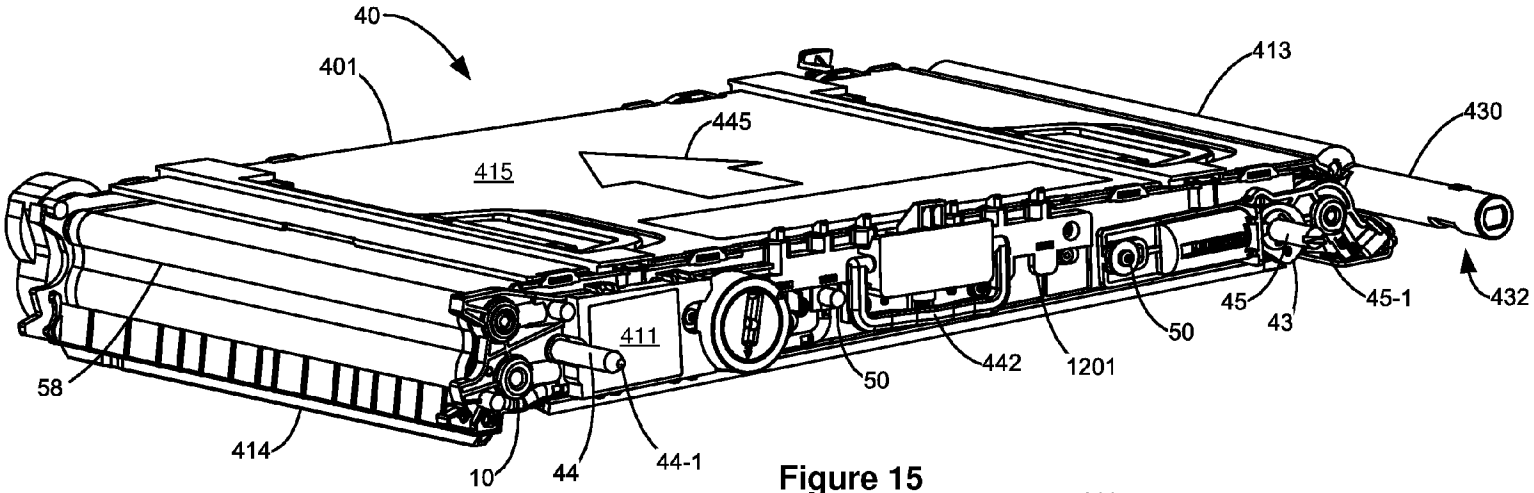
FIG. 15 is a front perspective view of an example ITB module.
Figure 16:
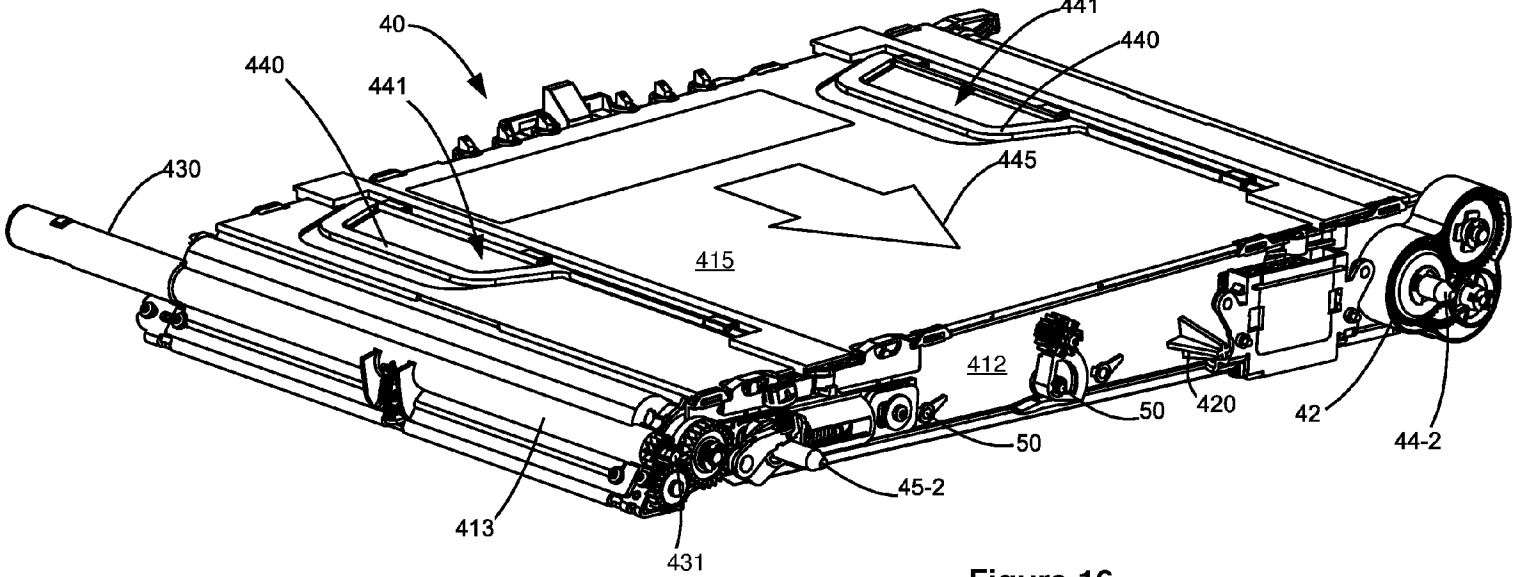
FIG. 16 is a rear perspective view of the ITB module of FIG. 14.
Figure 17:
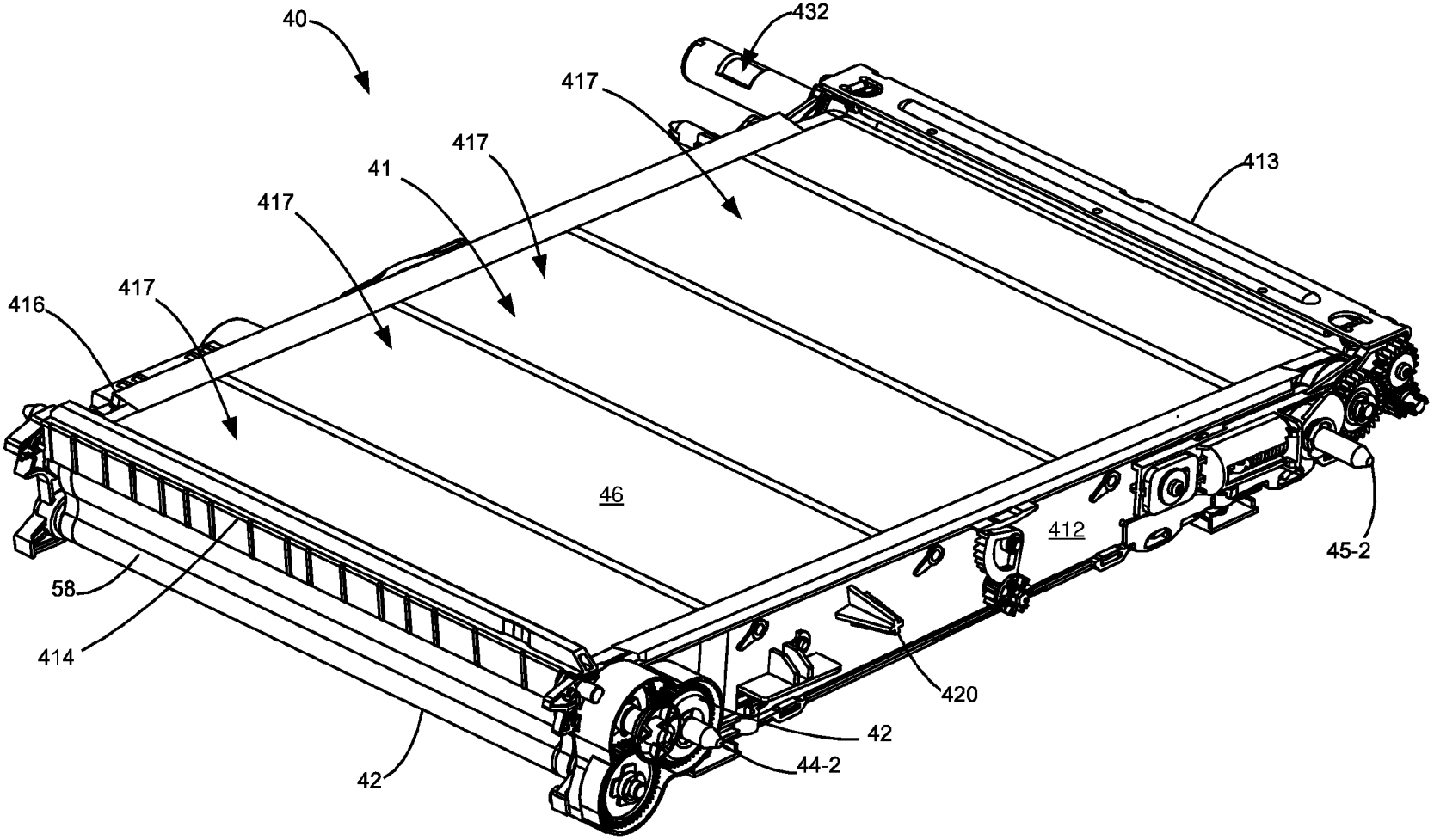
FIG. 17 is a bottom perspective view of the ITB module of FIG. 14.

FIGS. 15-17 illustrate an example embodiment of ITB module 40. A frame 410 is formed from front and back rails 411, 412, right and left end caps 413, 414, and top and bottom panels 415, 416. Bottom panel 416 has a plurality of openings 417 allowing contact between ITB 41 and imaging drums 60-63. Rolls 42, 44 are rotatably supported between front and back rails 411, 412 at opposite ends thereof with secondary belt roll 58 being rotatably supported between front and back rails 411, 412 adjacent to roll 42. First shaft ends 44-1, 45-1 project through front rail 411 while second shaft ends 44-2, 45-2 project through back rail 412. Transfer rolls 50 are also rotatably supported between front and back rails 411, 412. Scraper 59 is positioned beneath right end cap 413. Waste toner removed from ITB 41 by scraper 59 is fed into trough 430 in right end cap 413 and conveyed by an auger 431 to exit port 432. Foldable carry handles 440 are provided in corresponding recesses 441 in top panel 415. Two carry handles 440 are shown. Foldable front handle 442 is provided on front rail 411 and is used to insert and remove ITB module 40 into and from frame 20. Arrow 445 may be molded into top panel 415 to indicate to a user the insertion direction of ITB module 40 into frame 20. A guide 420 may be mounted on rear rail 412 to assist in the mounting and positioning of ITB module 40 into rear panel 22 of frame 20. Left and right end caps 413, 414 of ITB module 40 initially rest on rails 297, 298 of side panels 25, 26, respectively when ITB module 40 is inserted into frame 20 prior to access panel 202 being placed in the closed position.

While it has been stated that the rear panel 22 was used to establish the reference surface for front panel 21, top panel 23, bottom panel 24, and side panels 25, 26, it should be understood that front panel 21 may serve to establish the reference surface for the other panels.

The foregoing description of embodiments has been presented for purposes of illustration. It is not intended to be exhaustive or to limit the present disclosure to the precise steps and/or forms disclosed, and obviously many modifications and variations are possible in light of the above teaching. It is intended that the scope of the invention be defined by the claims appended hereto.

What is claimed is:

1. An electrophotographic printer, comprising:

an intermediate transfer belt (ITB) module having an endless belt wrapped around a first and second roll, each roll having a shaft therethrough having first and second shaft ends;

a plurality of imaging drums, each imaging drum having a first and a second shaft end;

a frame having a front panel, a rear panel, a first side panel, a second side panel and a bottom panel with the first and second side panels and bottom panel attached between the front and rear panels forming a rectangular box structure, one of the rear panel and the front panel establishing a reference surface for the front, bottom, and first side and second side panels and the rear, bottom, and first side and second side panels, respectively, the front panel having an access opening therethrough and a post mounted adjacent to one of the two lower corners of the access opening, the access opening sized to allow the ITB module and the plurality of imaging drums to be received between the front and rear panels;

the rear panel having a first set of openings and second set of openings aligned parallel to one another, the first set of aligned openings receiving the second shaft ends of the first and second rolls, the second set of aligned openings receiving respective second shaft ends of the plurality of the imaging drums;

an access panel removably attached to the front panel, the access panel having a third and fourth set of openings corresponding to the first and second sets of openings in the rear panel, respectively, the third and fourth sets of openings being parallel to one another, the third set of aligned openings receiving the first shaft ends of the first and second rolls and establishing an ITB reference plane, the fourth set of aligned openings receiving respective first shaft ends of the plurality of the imaging drums and establishing an imaging drum reference plane parallel to the ITB reference plane, the access panel having a post opening in a lower portion thereof for rotatably receiving the post, the access panel supported by the post and a camming device; and the camming device mounted on one of the access panel and the front panel and positioned adjacent the other one of the lower corners of the access opening;

wherein, in the event that the front panel and one of the first and second side panels is in a twisted position with respect to the rear panel that twists the ITB reference plane and the imaging drum reference plane causing a skew error, rotation of the camming device provides a skewing adjustment by pivoting the access panel about the post to adjust the angle of the access panel with respect to the front panel and the one of the first and second side panels to substantially correct the skew error of the ITB reference plane and the imaging drum reference plane while maintaining the mutual planarity therebetween.

2. The electrophotographic printer of claim 1 wherein, with the post and post hole being positioned within a predetermined range about either side of a vertical centerline of the first roll, an elevational change of the first roll with respect to the post due to the skew adjustment is in the range of +0.02 mm to about −0.02 mm.

3. The electrophotographic printer of claim 1 wherein, the access panel is attached to the front panel by at least one hinge positioned along a lower edge of the access panel and a lower edge of the access opening, and the at least one hinge has sufficient play to permit pivoting of the access panel by the camming device.

4. The electrophotographic printer of claim 1 wherein, at least one latch for removably attaching the access panel to the front panel is mounted adjacent to the top of the access panel.

5. The electrophotographic printer of claim 1 wherein, the camming device provides a skewing adjustment having a range of about −1.5 mm to about +1.5 mm.

6. The electrophotographic printer of claim 1 wherein, the first and second side panels have respective first and second side rails, and, when the ITB module is inserted through the access opening, the ITB module initially rests on the first and second side rails, and, when the access panel is attached to the front panel, the ITB module is lifted away from the first and second side rails as the first ends of the first and second shafts of the first and second rolls enter into the respective openings of the third and fourth sets of openings in the access panel.

7. The electrophotographic printer of claim 1 wherein, each opening in the second and fourth sets of openings is a self-centering opening.

8. The electrophotographic printer of claim 1 wherein the camming device has a body having a first portion and a second portion having a diameter that is greater than the first portion, the first portion being rotatably attached to the access panel having a first axis of rotation with the second portion of a body thereof being rotatably received into a corresponding hole in the front panel and having a second axis of rotation offset from the first axis of rotation wherein rotation of the camming device provides the skewing adjustment.

9. An electrophotographic printer, comprising:

an intermediate transfer belt (ITB) module having an endless belt wrapped around a first and second roll, each roll having a shaft therethrough having first and second shaft ends;

a plurality of imaging drums, each imaging drum having a first and a second shaft end;

a laser scan unit for producing a plurality of laser beams, each laser beam scanning a corresponding one of the plurality of imaging drums and having substantially the same focal length;

a frame having a front panel, a rear panel, a first side panel, a second side panel, a top panel, and a bottom panel with the first and second side panels and top and bottom panels attached between the front and rear panels forming a rectangular box structure, the rear panel establishing a reference surface for the front, top, bottom, first side and second side panels, the front panel having an access opening therethrough and a post mounted adjacent to one of the two lower corners of the access opening, the access opening sized to allow the ITB module and the plurality of imaging drums to be received between the front and rear panels;

the rear panel having a first set of openings and second set of openings aligned parallel to one another, the first set of aligned openings receiving the second shaft ends of the first and second rolls, the second set of aligned openings receiving respective second shaft ends of the plurality of the imaging drums;

an access panel hingedly attached to the front panel and moveable between an open position and a closed position with respect to the access opening, the access panel having a third and fourth set of openings corresponding to the first and second sets of openings in the rear panel, respectively, the third and fourth sets of openings being parallel to one another, the third set of aligned openings receiving the first shaft ends of the first and second rolls and establishing an ITB reference plane, the fourth set of aligned openings receiving respective first shaft ends of the plurality of the imaging drums and establishing an imaging drum reference plane parallel to the ITB reference plane, the access panel having a post opening in a lower portion for rotatably receiving the post, the access panel pivotable about the post; and a camming device mounted on one of the access panel and the front panel and positioned opposite to the post and adjacent the other one of the lower corners of the access opening;

wherein, in the event that the front panel, the bottom panel and one of the first and second side panels is in a twisted position with respect to the rear panel that twists the ITB reference plane and the imaging drum reference plane causing a skew error, rotation of the camming device provides a skewing adjustment by pivoting the access panel about the post to adjust the angle of the access panel with respect to the front panel, the bottom panel and the one of the first and second side panels to substantially correct the skew error of the ITB reference plane and the imaging drum reference plane while maintaining the mutual planarity therebetween, and, further wherein, the skewing adjustment substantially equalizes an error in the focal length of each laser beam due to the twisted position of the bottom panel on which the laser scan unit is mounted.

10. The electrophotographic printer of claim 9 wherein, the camming device provides a skew adjustment having a range of about −1.5 mm to about +1.5 mm.

11. The electrophotographic printer of claim 10 wherein, with the post and post hole being positioned within a predetermined range about either side of a vertical centerline of the first roll, an elevational change of the first roll with respect to the post due to the skew adjustment is in the range of +0.02 mm to about −0.02 mm.

12. The electrophotographic printer of claim 9 wherein, at least one latch for removably attaching the access panel to the front panel is mounted adjacent to the top of the access panel.

13. The electrophotographic printer of claim 9 wherein the first and second side panels have respective first and second side rails, and, when the ITB module is inserted through the access opening, the ITB module initially rests on the first and second side rails, and, when the access panel is attached to the front panel, the ITB module is lifted away from the first and second side rails as the first ends of the first and second shafts of the first and second rolls enter into the respective openings of the third and fourth sets of openings in the access panel.

14. The electrophotographic printer of claim 9 wherein, each opening in the first, second, third and fourth sets of openings is a self-centering opening.

15. The electrophotographic printer of claim 9 wherein, the camming device has a body having a first portion and a second portion having a diameter that is greater than the first portion, the first portion being rotatably attached to the access panel having a first axis of rotation with the second portion of a body thereof being rotatably received into a corresponding hole in the front panel and having a second axis of rotation offset from the first axis of rotation, wherein rotation of the camming device in a first direction upwardly pivots the access panel with respect to the post and rotation of the camming device in a second direction downwardly pivots the access panel with respect to the post.

* * * * *